US006125308A

United States Patent [19]

Hills et al.

[11] Patent Number: 6,125,308

[45] Date of Patent: Sep. 26, 2000

[54] METHOD OF PASSIVE DETERMINATION OF PROJECTILE MISS DISTANCE

[75] Inventors: David B. Hills, Kensington; Jonathan A. Bornstein, Abingdon, both of Md.

[73] Assignee: The United States of America as represented by the Secretary of the Army, Washington, D.C.

[21] Appl. No.: 08/872,524

[22] Filed: Jun. 11, 1997

[51] Int. Cl.[7] ..... F41G 7/00

[52] U.S. Cl. ..... 701/1; 244/3.11; 244/3.15

[58] Field of Search ..... 701/1, 2, 28, 6, 701/300, 302; 244/3.11, 3.15, 3.16, 3.17, 3.21; 348/114, 118; 342/357; 367/128; 102/232, 234, 244, 529, 248, 513

[56] References Cited

U.S. PATENT DOCUMENTS

| | | | |
|---|---|---|---|
| 3,699,577 | 10/1972 | Shadle | 342/357 |
| 3,724,783 | 4/1973 | Nolan, Jr. et al. | 244/3.15 |
| 3,990,657 | 11/1976 | Schott | 244/3.15 |
| 4,421,033 | 12/1983 | Dupont | 102/529 |
| 4,855,822 | 8/1989 | Narendra et al. | 348/114 |
| 4,862,785 | 9/1989 | Ettel et al. | 89/6.5 |
| 5,323,987 | 6/1994 | Oinson | 244/3.16 |
| 5,546,358 | 8/1996 | Thomson | 367/128 |
| 5,782,429 | 7/1998 | Mead | 244/3.11 |

OTHER PUBLICATIONS

J. Bornstein and D. Hills, "Miss distance indicator for tank Main Guns", 1996.

J. Bornstein and D. Hill, "Miss distnce indicator for Tank Main Gun Systems", 1994.

*Primary Examiner*—Jacques H. Louis-Jacques

*Attorney, Agent, or Firm*—Paul S. Clohan, Jr.; Mark D. Kelly; William E. Eshelman

[57] ABSTRACT

A method for determining the trajectory of a projectile on a ballistic trajectory includes creating a sequence of images of the projectile using a passive image sensor located at an observer; determining the time the projectile started on its trajectory; determining relative positions of the projectile's launch point, the observer, and an expected impact point; ballistically modelling the projectile; and tracking the projectile through the sequence of images using a track before detect algorithm.

4 Claims, 8 Drawing Sheets

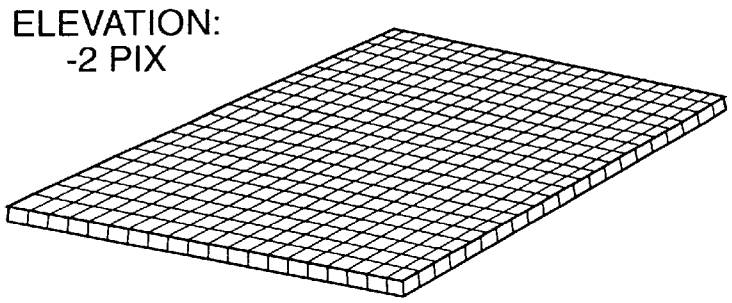
FIG. 4(a)
FIG. 4(b)
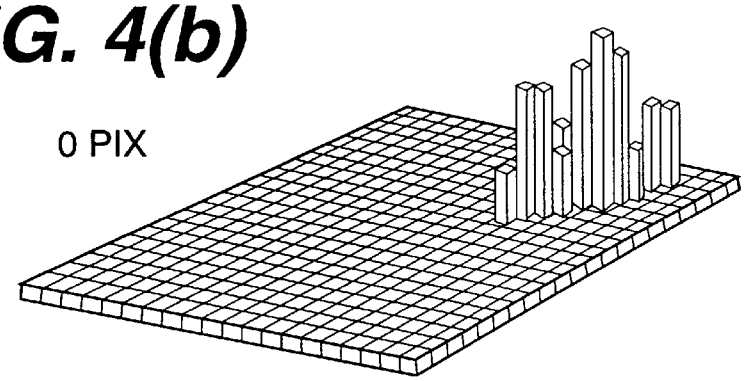
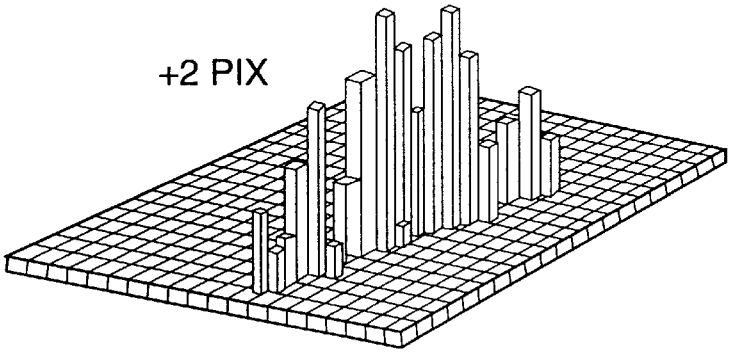
FIG. 4(c)
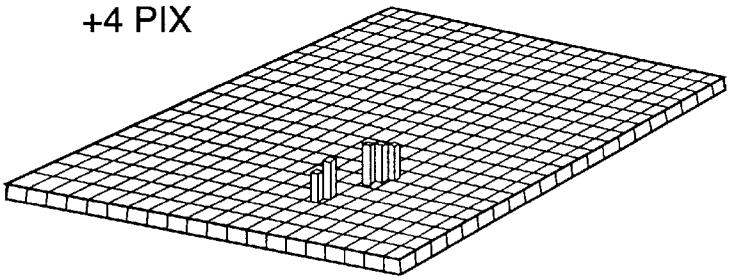
FIG. 4(d)

METHOD OF PASSIVE DETERMINATION OF PROJECTILE MISS DISTANCE

BACKGROUND OF THE INVENTION

The invention relates, in general, to the passive measurement of the trajectory of a ballistic projectile and, in particular, to the determination of the miss distance of a projectile fired from a tank main gun under tactical conditions.

Armor warfare emphasizes the tactical application of a tank's intrinsic maneuverability and firepower to close with, engage, and destroy enemy forces. The primary weapon system employed is the tank main gun which fires highly accurate, high velocity kinetic energy projectiles. Enemy forces are normally other armored vehicles, often in defilade. These opponents present relatively small targets, hence successful engagements demand a high degree of accuracy from both the main gun system and its ammunition. While both the main gun system and its ammunition are inherently accurate, variations in conditions between engagements (e.g. propellant temperature or thermal conditions of the gun system), not accounted for in the ballistic solution used by the fire control system, can lead to first round misses. When this occurs, the gunner has only a short time to correct aim and fire again before rounds are launched by the opposing forces. Estimation of the aim error is complicated by the natural tension of battle and the short timelines associated with tank engagements. A tactical advantage could conceivably be gained if the correction process, or at least the determination of the aim error, were automated in a fashion that would not degrade the normal firing tempo. An automatic miss distance indicator can assist in this correction process.

SUMMARY OF THE INVENTION

It is an object of the present invention to provide an automatic miss indicator to correct aim error.

This and other objects of the invention are achieved by a method for determining the trajectory of a projectile on a ballistic trajectory, comprising creating a sequence of images of the projectile using a passive image sensor located at an observer; determining the time the projectile started on its trajectory; determining relative positions of the projectile's launch point, the observer, and an expected impact point; ballistically modelling the projectile; and tracking the projectile through the sequence of images using a track before detect algorithm.

One aspect of the invention is an apparatus for determining the trajectory of a projectile on a ballistic trajectory, comprising a passive image sensor located at an observer; means for determining the time the projectile started on its trajectory; means for determining relative positions of the projectile's launch point, the observer, and an expected impact point; a ballistic model of the projectile; and means for tracking the projectile through a sequence of images using a track before detect algorithm.

Another aspect of the invention is a miss distance indicator, comprising a charge-coupled device camera for capturing images of a projectile to be tracked; a computer including a frame grabber card, connected to the camera; a muzzle flash indicator connected to the computer; and a timing circuit connected to the computer.

Further objects, features and advantages of the invention will become apparent from the following detailed description taken in conjunction with the accompanying drawing.

BRIEF DESCRIPTION OF THE DRAWING

FIGS. 4(*a*)–(*d*) show three-dimensional plots for several fixed values of elevation miss.

DETAILED DESCRIPTION OF THE PREFERRED EMBODIMENTS

A miss distance indicator is described in Bornstein, J. & Hillis, D., "Miss distance indicator for tank main gun systems," Acquisition, Tracking and Pointing VII, SPIE Vol 2221, pp316–326, 1994, United States, which is hereby expressly incorporated by reference. The indicator system, mounted on a "wing-man" tank, includes a CCD (charge-coupled device) camera and PC based image processing system, coupled with a separate infrared (IR) sensor to detect muzzle flash.

To successfully employ an automatic miss distance indicator with current generation tanks, it must be reliable, relatively low cost, and must respond rapidly, maintaining current firing rates.

Ideally, the automated indicator should display at least three characteristics. It should (1) employ passive sensors that do not add substantially to the tank signature, (2) be simple and have a low cost, to promote horizontal integration of the system into the current tank fleet without significantly impacting upon available space and power, and (3) have its function totally transparent to the gunner, i.e. minimize or, better still, not require operator intervention. The present invention seeks to achieve these goals through implementation of an indicator to track the projectile trajectory, as it flies towards its intended target, and deduce the true location of the projectile as it crosses the target plane, as illustrated schematically in FIG. 1.

Figure 1:
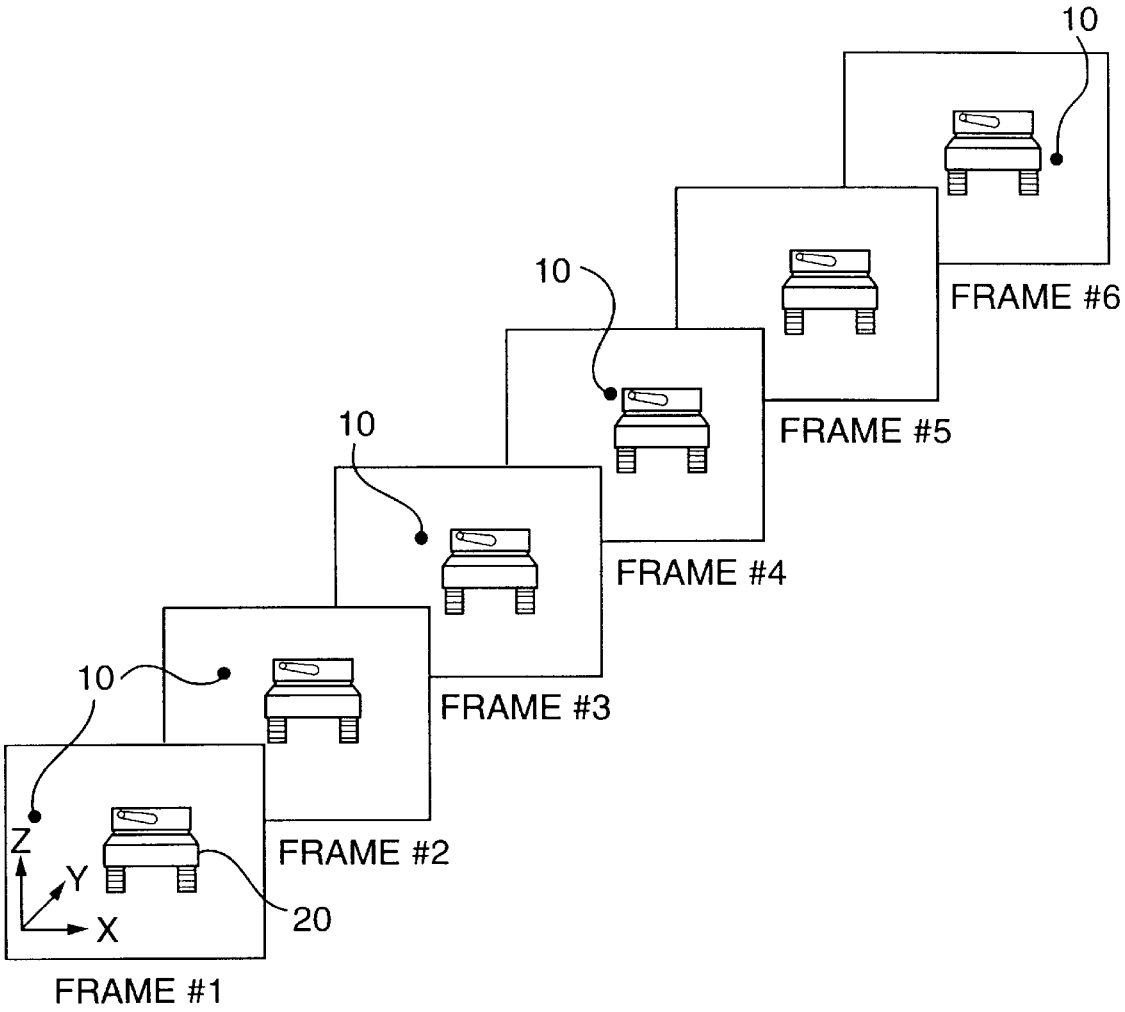
FIG. 1 schematically shows multiple frames taken from a CCD camera for tracking projectile trajectory.

FIG. 1 depicts six frames taken from a CCD camera. The projectile 10 crosses the image frames from left to right as it approaches the target 20. In Frame #4, the projectile 10 is in the plane of the target 20. In Frame #5, the projectile 10 is hidden by the target 20.

Figure 8:
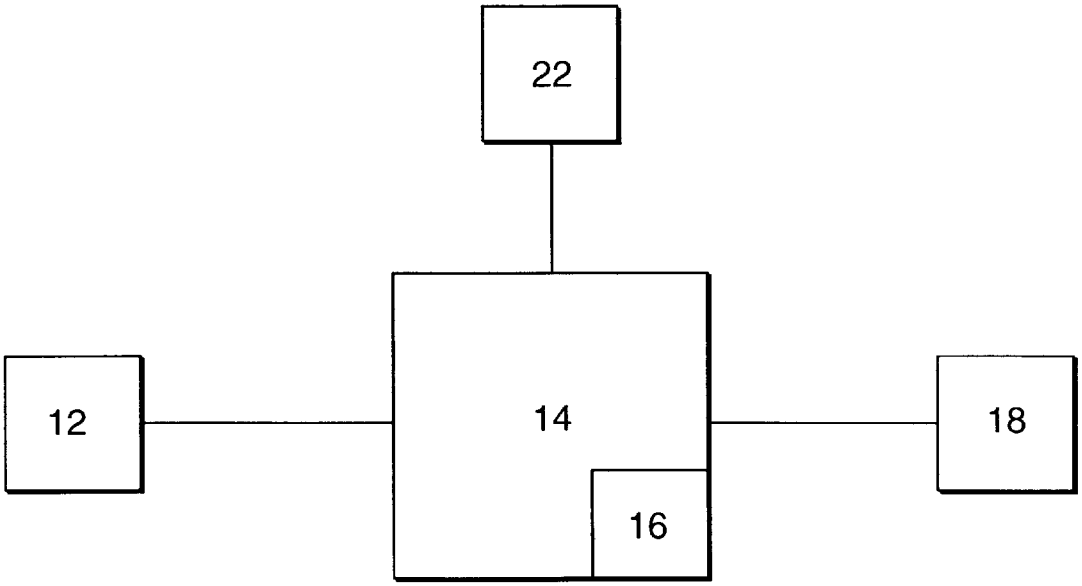
FIG. 8 is a schematic block diagram of the invention.

In one embodiment shown in FIG. 8, the invention uses a low-cost visible wavelength CCD camera 12 and a commercially available frame grabber card 16 mounted in a standard PC computer 14 to track the projectile path through successive frames of video. A timing circuit 22 is also included. Use of passive, imaging sensors, either in the visible or infra-red spectrum, minimizes any increase in the weapon system signature. The use of commercial "off the shelf" technology helps to reduce the total cost.

When a tank main gun is fired, a plume of hot, high pressure propellant gases follows the projectile out the muzzle, disturbing surrounding loose material and obscuring the view of the gunner for a brief period of time. The hot gases contained within the plume also tend to distort the downrange view from any position on the vehicle for as much as a few seconds. Since most modern kinetic energy (KE) projectiles have low drag profiles and launch velocities in excess of Mach 4, accurate miss distance determination is therefore precluded when a camera is mounted on the firing tank. To overcome this limitation, the miss distance is determined by an indicator mounted on an adjacent vehicle or "wingman".

Current American armor warfare doctrine normally has each tank platoon, the smallest maneuver element in a tank company, operating as two, two tank sections, with one tank in each section functioning as a wingman. Thus, the use of a wingman tank to correct fire is within the realm of current doctrine.

It is necessary to acquire four pieces of information to completely determine the aim error. First is the instant of projectile launch. Second is a series of images of the projectile in flight, taken at known times, and the position of the projectile in each image. In one embodiment, the invention is configured to use a maximum of approximately 18 images, or about 0.6 seconds of data. Third is a ballistic model of the projectile. Fourth, to overcome the effect of parallax, are the relative positions of the firing tank, the observer and the target. From the third and fourth pieces of information the projectile time of flight can be calculated.

For the initial tests of the invention, measurements were performed at known surveyed locations with respect to both the firing vehicle and the target. The instant of projectile launch was determined using an infrared detector, with a control circuit designed to detect the rapid significant increase in IR illumination caused by muzzle flash. The nominal projectile muzzle velocity and aerodynamic performance were obtained from a knowledge of the type of round fired.

In determining the target impact error, or miss distance, one is attempting to ascertain the instantaneous projectile position in three dimensions through the analysis of a series of two dimensional images. In the simplest case, consider an observer stationed on the firing tank viewing the projectile path as the round proceeds downrange. The instantaneous values for azimuth and elevation angles are known to the observer, but the projectile downrange position cannot be directly determined. Since the observer cannot know precisely when the projectile has crossed the target plane, the impact error cannot be accurately evaluated. This impediment can be overcome by making some assumptions about the projectile trajectory.

In the following analysis it will be assumed that the rounds being tracked are fin-stabilized, slowly rolling projectiles. This description is consistent with modern American tank main gun ammunition. The predominant forces acting upon the projectiles are gravity and drag. Lift due to the initial yawing motion of the projectiles can be modeled as an initial launch disturbance that results in some initial launch angle that is invariant throughout the projectile trajectory. Since the spinning motion of the rounds is negligible, it will be assumed that the azimuthal coordinate of the projectile trajectory is constant (i.e., the horizontal trajectory component is a straight line). It will also be assumed that the type of round fired is known and the drag forces acting on the round can be determined as a function of projectile velocity from standard firing tables. A third order polynomial may be used to model the drag or, actually, the loss of velocity per unit range. The value of superelevation (additional vertical launch angle placed on the gun to compensate for the effect of gravity) used by the fire control system is known and is again based upon the standard firing table for the round. Again, a third order polynomial may be used to model the firing table data. Launch disturbances that lead to round to round variability of target impact are assumed to be small with respect to the impact errors sensed by the miss distance indicator. This leaves three "biases": azimuthal launch disturbance, elevation launch disturbance and which are presumed to occur due to differences in conditions between firing occasions and will therefore remain invariant between the first and subsequent rounds fired during the same occasion.

The miss distance problem reduces to the determination of the three biases or initial conditions by finding the set of initial conditions yielding the best match between the computed trajectory and the image data. To simplify this search process, the assumption that the projection of the trajectory in the ground plane (i.e., azimuthal trajectory coordinate) remains constant throughout the projectile flights will be used. While this is not always true, for the ranges being considered here (less than a few kilometers), the magnitude of the errors introduced by this assumption are insignificant.

Standard geometric transformations are used to transfer the frames of reference from the firing tank to the wing man tank. Two coordinate systems are defined. The first is a Cartesian coordinate system centered on the firing tank and is employed for the computation of the projectile trajectory. The second is a spherical coordinate system centered on the observer, from which the "azimuth" and "elevation" coordinates of the projectile in each of the captured images can be directly obtained.

In an exemplary embodiment, a set of three nominal projectile muzzle velocities (corresponding to a range of ±40 m/sec centered about the nominal muzzle velocity for a projectile fired at ambient, i.e., 21 degrees C. propellant temperature) are chosen. Treating each frame independently, the azimuthal and elevation launch angles necessary to match the location specified by the image data are computed. With a track before detect algorithm, which employs a least squares fitting procedure, a linear function defining the azimuthal launch angle as a function of range (or frame number) is determined for each of the three nominal muzzle velocities. Through interpolation it is then possible to define a unique muzzle velocity that will both yield a trajectory with a single azimuthal component of launch angle and match the projectile locations captured in each frame of the image data.

In one embodiment, the miss distance indicator system (MDIS) comprises a CCD video camera (for example, Sanyo model 3860) with a 600 mm focal length lens (for example, Nikon brand), IR flash detector (for example, AVL model BAL607), timing circuit and an Automatic Target Acquisition (ATA) system. System input parameters include relative position of the observer with respect to the firing tank, range to target and projectile type.

Once armed, the system remains in a wait state until triggered by the IR detector and timing circuit at the initiation of the firing event. The timing circuitry also provides the ATA system a synchronization signal taken from the output of the video camera, in addition to the trigger signal. Additional outputs provide for the recording of the video signal on a standard VHS video recorder. This recording with additional synchronization signals placed on the audio portion of the tape permit additional post-test data evaluation. The ATA system comprises a portable computer (for example, DOLCH 486-33) with an image processing card (for example, SHARP GPB-1 w/ INCARD daughterboard) and software.

An exemplary sequence of steps of the miss distance indicator are as follows:

1. Main tank lines up a shot, and lases on the target to obtain the range to the target.
2. Main tank sends radio message to wingman indicating the projectile type to be used, the tank's position (from Global Positioning System), and the target's three dimensional position from range and turret angle).
3. Wingman operator points camera at the target, finds the target in the image and designates the center pixel of the target using a computer cursor.
4. Wingrnan points an Infrared flash detector at the main tank.
5. Computer program on wingman calculates the nominal ballistic trajectory for the indicated projectile type (using a model that accounts for gravity drop and air friction) assuming that the projectile is fired from the main tank on a path toward the center of the target.
6. Computer program on wingman uses geometrical transformations to translate the three-dimensional nominal projectile path into the two-dimensional coordinate system of the camera. This process produces a prediction of where in the camera image the projectile's image will fall for any given time.
7. Computer program on wingman goes into a waiting state while continously checking the parallel input port.
8. Main tank fires.
9. Flash detector on wingman detects firing event and signals the computer with a TTL level signal on the parallel input port.
10. Computer program on wingman receives signal from flash detector and records the time.
11. Computer program on wingman waits until the estimated time at which the projectile will be visible in the camera image, then starts the image collection phase.
12. Computer program on wingman performs "track before detect" (TBD) operation to calculate miss distance in azimuth and elevation and corresponding correction, if any, for a second shot. 13. Computer program on wingman sends correction to main tank.

Details of Step11—Image Collection Phase

The image collection phase captures a sequence of images from the wingman camera and forms two images from them. The first image, called "MAX", is formed by calculating, for each pixel, the maximum greyscale value (intensity) for that pixel, occuring throughout the sequence of images, and assigning that maximum value to the pixel in the MAX image. The second image, called "TAG", contains a number, for each pixel, indicating which image in the sequence contained the maximum value assigned to that pixel, in the MAX image.

The image collection process is as follows:

1. Set the counter variable "frame_number" to 0. Set all locations in the image memories "TAG1", and "MAX1" to 0.
2. Capture an image, from the video camera, using the frame grabber on the SHARP GPB 1 card, and load it into an image memory which we will call "NEW". Calculate the time the image was captured (by the camera, not the card), relative to the time the shot was fired, and store this time in an array. Increment "frame_number" by 1 so that, for the Nth frame in the sequence, frame number will equal N.
3. Take the difference NEW—MAX1 and put it in image memory "M". Each pixel in M will be 0 unless the NEW pixel value is greater than the MAX1 pixel value. (Fixed, 8 bit arithmetic is used for the above operations: if an image subtraction operation produces a negative value for a pixel, that value is fixed at 0 before being loaded into the image memory.)
4. Calculate the result of a thresholding operation on M, such that every pixel, of value 0, remains at 0, but pixels with values greater than 0, are all set equal to the value of frame number. Put this thresholded image in image memory "T" while leaving M unchanged.
5. Take the maximum value for each pixel in image memories TAG1 and T and place the result in image memory "TAG2".
6. Add images MAX1 and M and put the result in image memory MAX2.
7. Repeat steps 2–5 for each image to be captured, with the roles of image memories MAX1 and MAX2 and also TAG1 and TAG2 reversed for each iteration.
8. The last image memory updated, MAX1 or MAX2, holds the MAX image. The last image memory updated, TAG1 or TAG2, holds the TAG image.

Details of Step 12.—The TBD Operation

For each possible initial velocity, for each image in the captured sequence, for each possible azimuth miss, for each possible elevation miss, perform the following steps:

1. Calculate the elapsed times between the firing of the projectile and the capture of each field of that image. (As is conventional, the images are interlaced. The odd field is captured 0.017 seconds after the even field. )
2. Calculate the expected x and y pixel position (for the wingman camera) for a projectile with that initial velocity, azimuth miss, and elevation miss at that time.
3. Examine the value for that pixel position in the TAG image, to see if it matches the image's number. (This is a test to see whether the maximum greyscale value found in the image sequence, for that pixel, occurred in the present image.)
4. If YES: Add the pixel value from the MAX image to the score of the hypothesis corresponding to this particular initial velocity, azimuth miss, and elevation miss.
5. If NO: make no change.
6. The hypothesis with the highest score indicates the actual initial velocity, azimuth miss, and elevation miss of the projectile.

Image Processing

The objective of the image processing is to observe a sequence of images or frames originating from the camera, detect the location of the tank projectile in those frames in which it is in view and construct its two dimensional path in the image plane. This path represents the projection of the three dimensional trajectory followed by the projectile. The actual three dimensional path can then be reconstructed using ballistic modeling and knowledge of the geometry of the scenario.

Because the tank projectiles are equipped with tracers, the signal to noise ratio is high. However, since the targets are typically some kilometers distant, optical distortion from atmospheric effects can cause rapid intensity fluctuations around bright objects or edges in the background. These can be largely filtered out by forming a reference image shortly before firing in which bright areas are blurred outward into surrounding darker areas. Subtracting this reference image from subsequent ones eliminates many false signals from atmospheric effects and sensor jitter. However, as the indicator is intended for use in tactical scenarios, it must also be capable of operation in the presence of significant moving clutter.

Timing Circuit

The indicator time functions on a portable computer were initially unsuitable due to their low resolution and other undesirable features. However, the portable computer's timing chip, an INTEL 8254, can be controlled directly. The 16 bit counter on the chip is incremented at about a 2-MHz rate. The ATA system reads the chip's count directly (only the upper 8 bits ) and keeps track of counter roll-over (36 times per second) in software. When the timing circuit detects the tank's muzzle flash, and sends the start signal, the ATA system reads the timer chip and starts the count. The ATA system then monitors the camera's video synchronization signal (sent from the timing circuit) and measures the time till its next leading edge. (The random phase of the camera sync, pulse relative to the flash detection signal is thus accounted for.). Then at every second leading edge of the sync. pulse (about every 0.03336 seconds—at the beginning of each video frame), the count from the timer chip is read and stored. The range from the tank to the target and a model for the velocity of the tank round is used to calculate the time when the round will come into view. At the appropriate time, the processing system grabs and stores the images at a 30 Hz rate. The time associated with each image is the time of the camera sync. pulse, not the time it was read into the processing system. The difference between the time for the image and the time of the flash detection is the time of flight for the tank round up to the time of the image.

Using the sync. signals from the VCR tapes for comparison, the time measurements are repeatable to within 0.1 milliseconds, consistent with only using the top 8 bits of the counter and well within the design goals. Higher accuracy time measurements could be achieved simply by using the full 16 bits read out of the timer chip should that prove warranted.

In one embodiment of the indicator, a "detect before track" (DBT) rather than a TBD approach is used. For each frame, the positive difference between the frame and the reference image is taken, and a histogram based, adaptive threshold is applied. The pixels passing the threshold are clustered and the clustered detections are passed or rejected based on a size filter. The pixel locations for each remaining detection are compared to the anticipated projectile location and the detection having the closest match is chosen as the sole detection for that frame. When all 18 frames have been processed, a clustering technique is used to find and eliminate outliers (detections representing miss distances significantly different from the average). Finally, the set of detections is used to determine the miss distance and initial velocity using a linear fit method as described above.

The DBT embodiment has the advantage that it can be implemented in real-time using relatively inexpensive commercial hardware. On the other hand, it suffers the drawbacks that achieving truly robust automatic thresholding is elusive and that false alarms from clutter near the projectile's path (in time and space) may cause errors in the linear fit.

The TBD embodiment restricts the search to just a tiny fraction of the number of possible non-linear trajectories, making it possible to apply in real-time on relatively inexpensive hardware. In the TBD embodiment, a plurality of consecutive images are captured and are processed to produce two images to be used for the TBD processing. Embodiments in which TBD is applied over the original images captured or in which other processing steps are applied prior to the TBD step fall within the scope of this invention. Embodiments in which the methods described are used to determine other aspects of an object's trajectory (such as parameters of the ballistic model, range to the target, etc.) also fall within the scope of this invention.

In the TBD embodiment, the relevant information from a sequence of images may be stored in two image memories. Once the IR detector signals that the projectile has been fired, the system calculates when the projectile is likely to be in the camera's field of view, then captures and processes the camera frames falling within that period. The products of this processing are two images: MAX and TAG, the first holding the maximum gray scale value encountered during the sequence for each pixel, the other holding the timing information: where the value for each pixel represents the frame number during which the maximum value was encountered. ( An additional step of subtracting the difference image can improve performance, at the cost of additional processing time and some lost sensitivity.) Since each image holds 8 bit values, up to 256 frames (8.5 seconds) could be accommodated before requiring additional storage.

Figure 2A:
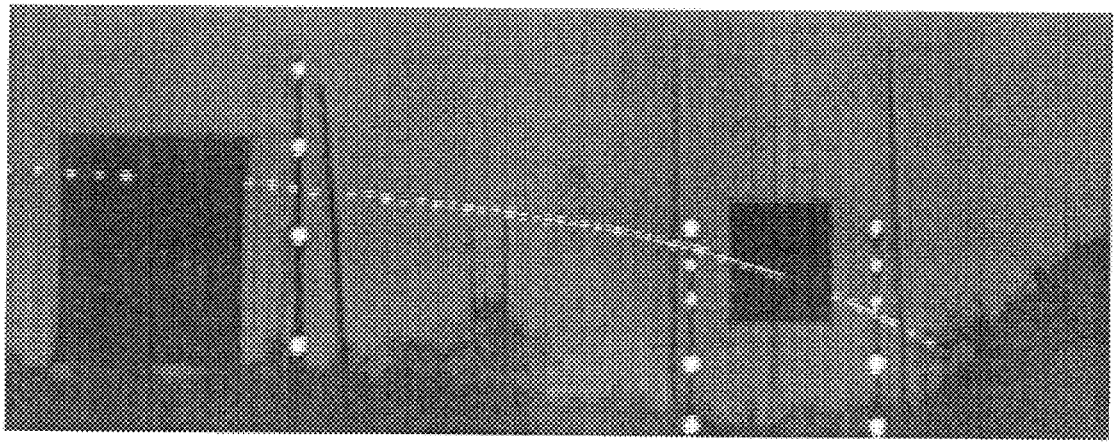
FIG. 2(*a*) shows the MAX image and FIG. 2(*b*) shows the TAG image for a tank round fired at a target 1500 meters away.
Figure 2B:
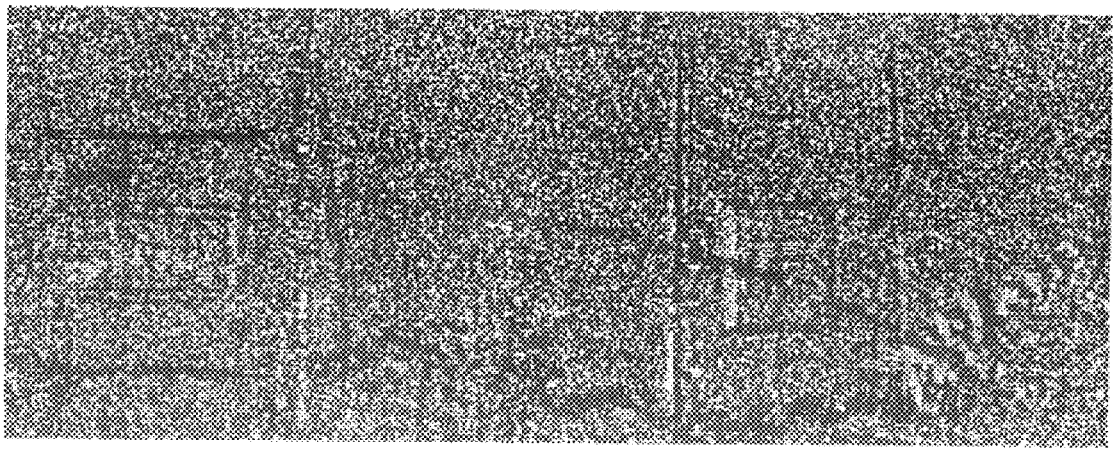

FIG. 2(*a*) shows the MAX image and FIG. 2(*b*) shows the TAG image for a tank round fired at a target 1500 meters away. The small rectangle in the right-hand side of FIGS. 2(*a*) and (*b*) is the target. The series of white dashes in FIG. 2(*a*) is the path of the projectile. The series of white dashes appears to comprise two parallel lines because of the effect of interlacing.

A TBD system searches through a number of possible paths and compares how well each correlates with the data captured. See, for example, S. C. Pohlig, "Maximum Likelihood Detection of Electro-Optic Moving Targets", Massachusetts Institute of Technology, Lincoln Laboratory, Technical Report 940, 1992, which is hereby expressly incorporated by reference. Algorithms assuming a linear velocity in the plane of the image could not be directly applied in this case because of the non-linear paths made by the projectiles in the image.

Testing the set of all non-linear paths would be a daunting task. Fortunately, the set of probable paths, in this case, is highly constrained. The projectile type is known and its three-dimensional path, for a given initial velocity and pointing angle (which corresponds to the miss distance), can be accurately modeled. The range of probable initial velocities and miss distances are limited. The time when the gun was fired is known as are the relative positions of the firing tank, the wing man, and the target. While the range of possible trajectories to test remains large, it has been reduced to a practical number.

Each hypothesis to be tested consists of a miss angle in elevation, a miss angle in azimuth and an initial velocity. For each hypothesis, the system calculates a three-dimensional trajectory including a position for each time step (where each time step corresponds to a particular frame captured from the camera). Then the 2-dimensional projection of that trajectory is used to determine in which pixel in the images the projectile should fall for each time step.

The strength assigned to each hypothesis is a function of how closely the predicted pixel positions correspond to the data. For each time step, the value of the indicated pixel in the TAG image is tested to see if that pixel was updated at that particular time step. If the times match, then the strength for the hypothesis is increased by the gray scale value for the same pixel address in the MAX image. If the times do not match, nothing is added. The figures below show some results of this technique for the data from one of the shots observed.

Figure 3:
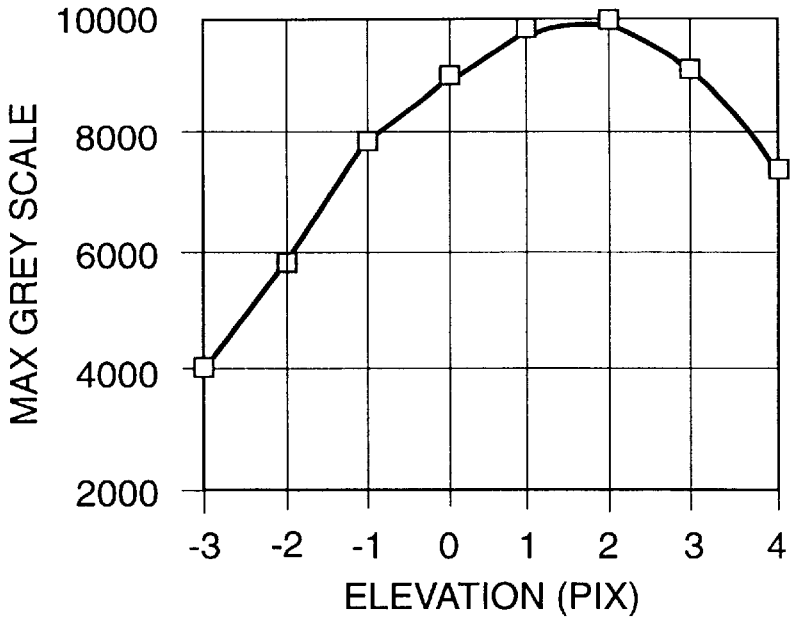
FIG. 3 is a plot, from a test shot, showing the maximum grey scale strength (over the range of the initial velocities and azimuth offsets) as a function of elevation misses.

Testing the different hypotheses corresponds to measuring points on a four-dimensional surface. Different choices of initial velocity, elevation miss, and azimuth miss result in different strengths reflecting the closeness of the match between predicted and measured data. FIG. 3 is a plot, from a test shot, showing the maximum strength (over the range of the initial velocities and azimuth offsets) for several elevation misses. The peak is slightly below two pixels, which matches the ground truth for that shot. In the following discussion, the azimuth and elevation miss distances are described in terms of "pixels" , where one "pixel" corresponds to the angle subtended by an actual pixel in the camera system used.

FIGS. 4(*a*)–(*d*) are three-dimensional plots showing strength as a function of azimuth miss angle versus initial velocity for four fixed elevation misses. The highest point for each plot corresponds to the maximum strength shown in FIG. 3. The hypothesis with the highest strength has an initial velocity of 1148 m/s, an elevation miss of two pixels, and an azimuth miss of six pixels. This answer matches the ground truth for projectile speed and miss distance very closely.

Figure 5A:
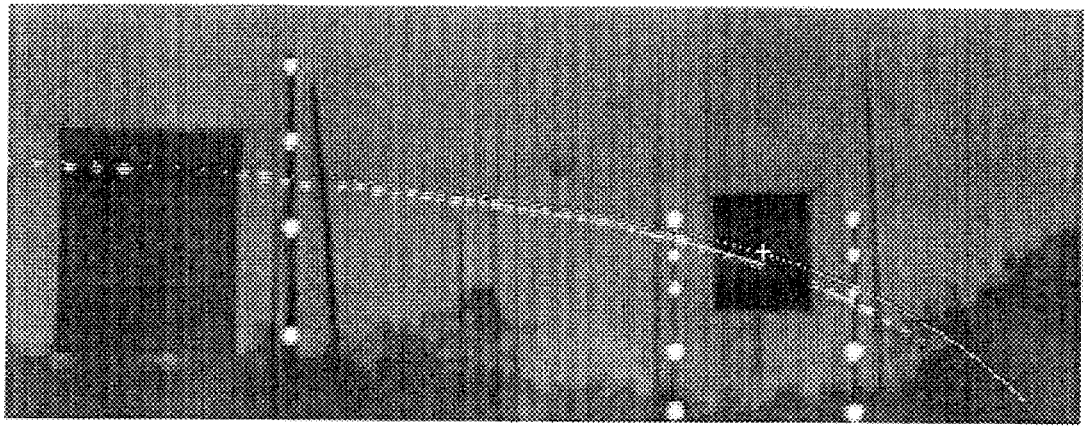
FIGS. 5(*a*) and (*b*) show 2 possible trajectories, each superimposed on the MAX image of FIG. 2(*a*).
Figure 5B:
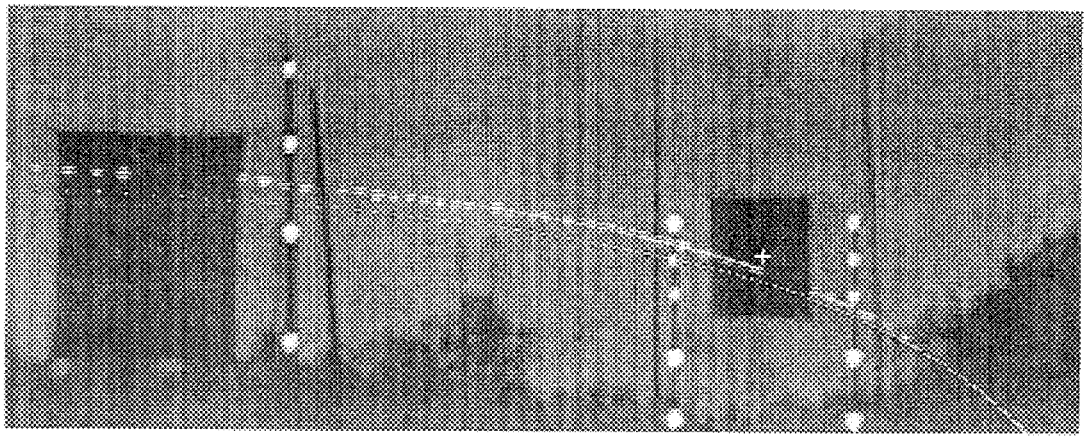

FIGS. 5(*a*) and (*b*) show 2 possible trajectories, each superimposed on the MAX image from FIG. 2. Each dot represents the predicted pixel location for the projectile at a time corresponding to the measured time, subsequent to the time of firing, at which one of the frames was collected. The cross hair is positioned at the center of the target.

Figure 6A:
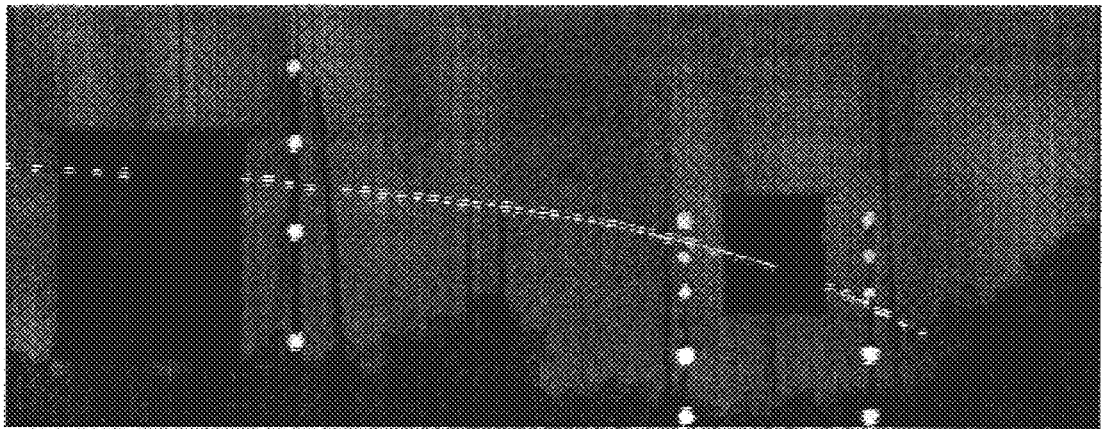
FIG. 6(*a*) shows the MAX image and FIG. 6(*b*) shows the MAX image with the winning hypothesis superimposed.
Figure 6B:
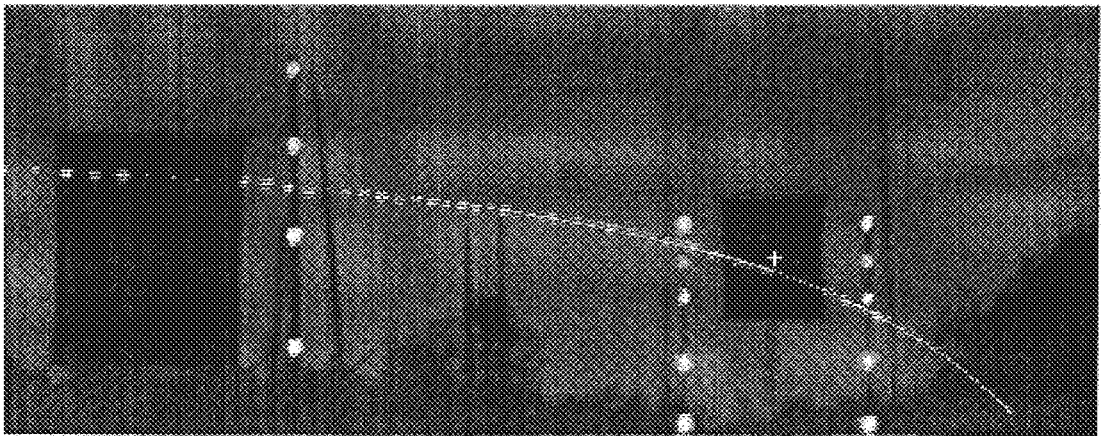

FIG. 6 shows the MAX image of FIG. 2(*a*) with the winning hypothesis superimposed.

Figure 7:
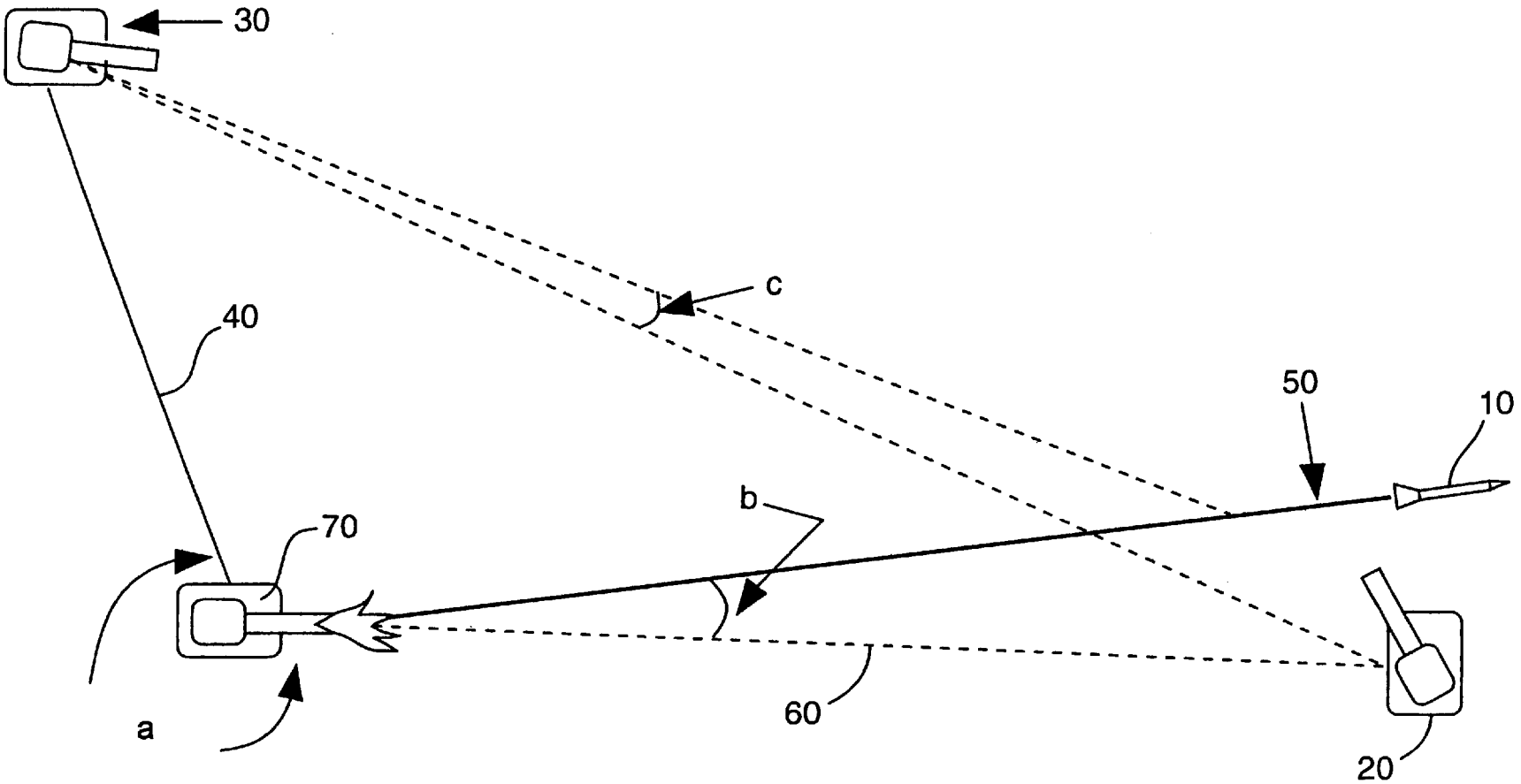
FIG. 7 shows the geometry for the invention.
Figure 9:
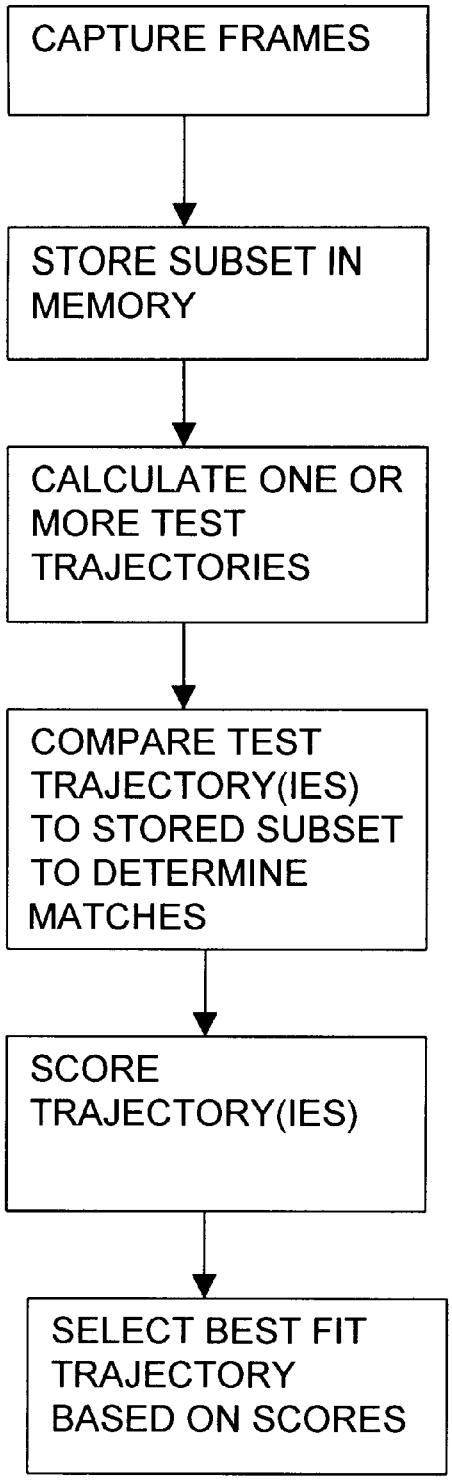
FIG. 9 shows a flow chart of an aspect of the invention.

FIG. 7 shows an example of the geometry for the invention. A target tank 20 to be destroyed is fired on by a firing tank 70. Numeral 60 represents the line of sight to the target. The true trajectory of the projectile 10 is represented by the line 50. The wing man tank (observer) 30 is offset from the firing tank 70 as shown by line 40. Angle a is the azimuth of the wing man tank 30, angle b is the actual miss angle and angle c is the apparent miss angle.

The TBD embodiment takes advantage of the fact that the predicted pixel locations for a hypothesis can be approximated as a linear shift of the locations for another hypothesis with the same initial velocity. For hypotheses with miss distances sufficiently close together the errors in pixel location resulting from such an approximation will be less than one pixel and therefore can be ignored without cost.

An exemplary subroutine in C code for testing each hypothesis to find the best match with the data is as follows:

```
HypTest(g, Time_stamp)
struct geom *g;
long Time_stamp[];
{
int i,pix,mpix,hits,sum;
int x_cnt,y_cnt,vel_cnt,x,y;
int max_x,max_y,max_v,max_sum,meta_x,meta_y,meta_sum
double meta_vel;
int xysum[2000],address,size,xoff,yoff;
meta_sum = 0;
for (vel_cnt = lowest_velocity; vel_cnt < highest_velocity;
vel_cnt+=2)
                    /* Velocity Loop */
{
g->vel = (double)(vel_cnt);
geometry(g,2);
```

-continued

```
printf("Velocity = %f\n",g->vel);
hits = 0; sum = 0;
for (i=0;i<size*size;i++) xysum[i]=0;
/* initialize array of hypothesis scores*/
for (i=0;i<255;i++)        /* Time Loop */
    {                /* EVEN field */
    elapsed = Time_stamp[i];
/*time between firing and capture of ith image*/
    for (y_cnt = 0; y_cnt < size; y_cnt+=1)
     for (x_cnt = 0; x_cnt < size; x_cnt++)
        {
        address = y_cnt*size + x_cnt; /* address into xysum[]*/
        pixel_position(g->muzzle_angle,g->vel,elapsed,p_type,
            &g->xexpect,&g->yexpect,x_cnt,y_cnt);
        x = g->xexpect; y = g->yexpect;
        if(y % 2) {y += 1;} /* get onto even line */
        s_getpix(P2,B3,x,y,&mpix);/* pixel value from Max image */
        s_getpix(P1,B2,x,y,&pix); /* pixel value from Tax image */
        if((x<1)||(x>511)) {mpix = 0;}
/* if the TAG value matches the image number, increase the score. */
        if(i==(pix-1)) {xysum[address] += mpix;}
        }
                /* ODD field */
    elapsed += (.5 * .03336);
/* odd field is captured one half frame time later */
    for (y_cnt = 0; y_cnt < size; y_cnt+=1)
     for (x_cnt = 0; x_cnt < size x_cnt++)
        {
        address = y_cnt*size + x_cnt;
            /* address into xysum[] */
        pixel_position(g->muzzle_angle,g->vel,elapsed,p_type,
            &g->xexpect,&g->yexpect,x_cnt,y_cnt);
        x = g->xexpect; y = g->yexpect;
        if(!(y % 2)) {y += 1;} /* get onto odd line */
        s_getpix(P2,B3, x,y, &mpix);/* pixel value from Max image */
        s_getpix(P1,B2, x,y, &pix); /* pixel value from Tax image */
        if((x<1)||(x>511)) {mpix = 0;}
/* if the TAG value matches the image number, increase the score. */
        if (i==(pix-1)) {xysum[address] += mpix;}
        }
    }   /* end of Time Loop */
/* Find x,y that produce best hypothesis for this velocity */
max_sum = 0;
for (y_cnt = 0; y_cnt < size; y_cnt+=1)
for (x_cnt = 0; x_cnt < size; x_cnt++)
    {
    address = y_cnt*size + x_cnt; /* address into xysum[] */
    if (xysum[address] > max_sum)
        {
        max_sum = xysum[address];
        max_x = x_cnt;
        max_y = y_cnt;
        }
    }
/* Keep track of best hypothesis encountered and store it in meta_sum,
meta_x,meta_y,meta_vel*/
if (max_sum > meta_sum)
    {
    meta_sum = max_sum;
    meta_x = max_x;
    meta_y = max_y;
    meta_vel = g->vel;
    }
printf("Max so far: vel=%. 1f x,y %d, %d: sum =%d\n",
meta_vel,meta_x,meta_y,meta_sum);
}               /* end of Velocity Loop */
}/************************ end of HypTest ****************/
```

This minimum distance can be calculated for the particular scenario chosen and many hypotheses can be tested in parallel. First, the predicted pixel locations for one center hypothesis are calculated. Then, instead of performing the steps of checking the TAG image and integrating across the MAX image for only those predicted pixel locations, the same operations are performed, in parallel, on sub-images or "windows" centered around those pixels. The result for each pixel in the window represents the result for a hypothesis with the same initial velocity as that of the center hypothesis but with different elevation and azimuth miss distances which correspond to its relative position in the window. The window size is set at a value such that all of the hypotheses included will have miss distances sufficiently close to the center hypothesis that the approximations remain valid. The total hypothesis space to be tested can then be divided into as many windows as needed and Commercial Off The Shelf (COTS) image processing hardware can be used to perform much of the processing in parallel.

The "best" hypothesis determined by the above described parallel procedure may be further refined. A small number of hypotheses, close to the "best" hypothesis, may be tested to produce a more accurate estimate of the actual best hypothesis.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method for determining the trajectory of a projectile on a ballistic trajectory, comprising:

capturing a timed sequence of image frames of the projectile in flight, each image frame comprised of pixels;

comparing the grey-scale intensity of pixels at corresponding positions of each image frame of the sequence to arrive at a composite representing maximum intensity pixels;

determining the times at which each such maximum intensity pixel was captured;

calculating at least one array of test pixels corresponding to at least one estimated trajectory of the projectile;

comparing the at least one array of test pixels to the times of the maximum intensity pixels to determine pixel matches;

using the pixel matches to arrive at a score for each such estimated trajectory;

selecting a best-fit estimated trajectory based on the score for such estimated trajectory.

2. The method of claim 1, further comprising:

using the intensity values of the maximum intensity pixels corresponding to the pixel matches to select the best-fit estimated trajectory.

3. A method for determining the trajectory of a projectile on a ballistic trajectory, comprising:

capturing a timed sequence of image frames of the projectile in flight, each image frame comprised of pixels, each pixel including a grey-scale value, image location and time of capture;

storing in memory a subset of the pixels in the sequence of frames, comprising the pixel grey-scale value, image location, and time of capture;

calculating at least one array of test pixels corresponding to at least one estimated trajectory of the projectile;

comparing the at least one array of test pixels to the times of the stored pixels to determine pixel matches;

using the pixel matches to arrive at a score for each such estimated trajectory;

selecting a best-fit estimated trajectory based on the score for such estimated trajectory.

4. The method of claim 3, further comprising:

using the intensity values of the stored pixels corresponding to the pixel matches to select the best-fit estimated trajectory.

* * * * *